US011926939B2

(12) United States Patent
Kim et al.

(10) Patent No.: US 11,926,939 B2
(45) Date of Patent: Mar. 12, 2024

(54) SUPER ABSORBENT POLYMER NON-WOVEN FABRIC AND PREPARATION METHOD OF THE SAME

(71) Applicant: LG Chem, Ltd., Seoul (KR)

(72) Inventors: Chanjoong Kim, Daejeon (KR); Woongchan Jeong, Daejeon (KR); Chang Sun Han, Daejeon (KR); Jae Hoon Choe, Daejeon (KR); Taebin Ahn, Daejeon (KR); Chang Hun Lee, Daejeon (KR)

(73) Assignee: LG Chem, Ltd. (KR)

( * ) Notice: Subject to any disclaimer, the term of this patent is extended or adjusted under 35 U.S.C. 154(b) by 574 days.

(21) Appl. No.: 16/757,651

(22) PCT Filed: Oct. 26, 2018

(86) PCT No.: PCT/KR2018/012843
§ 371 (c)(1),
(2) Date: Apr. 20, 2020

(87) PCT Pub. No.: WO2019/088597
PCT Pub. Date: May 9, 2019

(65) Prior Publication Data

US 2021/0079571 A1 Mar. 18, 2021

(30) Foreign Application Priority Data

Oct. 30, 2017 (KR) ..... 10-2017-0142612

(51) Int. Cl.
*D04H 1/407* (2012.01)
*D04H 1/4282* (2012.01)
(Continued)

(52) U.S. Cl.
CPC ..... *D04H 1/407* (2013.01); *D04H 1/4282* (2013.01); *D04H 1/724* (2013.01); *D04H 3/007* (2013.01); *D04H 3/016* (2013.01); *D04H 3/03* (2013.01)

(58) Field of Classification Search
CPC ..... D04H 1/407; D04H 1/724; D04H 1/4282; D04H 3/007; D04H 3/016; D04H 3/03;
(Continued)

(56) References Cited

U.S. PATENT DOCUMENTS 4,654,038 A 3/1987 Sakurai
4,861,539 A 8/1989 Allen et al.
(Continued)

FOREIGN PATENT DOCUMENTS

CN 1285010 A 2/2001
CN 102144054 A 8/2011
(Continued)

OTHER PUBLICATIONS

Allan, David S.: "Other Superabsorbent Polymer Forms and Types" In: Buchholz, Fredric L.; Graham, Andrew T.: "Modern Superabsorbent PolymerTechnology", 1998, Wiley VCH, Canada, XP002799531, ISBN: 0-471-19411-5, pp. 223-249, pp. 224-225.
(Continued)

*Primary Examiner* — Lynda Salvatore
(74) *Attorney, Agent, or Firm* — Lerner David LLP

(57) ABSTRACT

The present disclosure relates to a preparation method of a super absorbent polymer non-woven fabric and super absorbent polymer fibers prepared therefrom. According to the preparation method of the present disclosure, it is possible to provide super absorbent polymer fibers exhibiting high flexibility and fast absorption rate in the form of long fibers.

13 Claims, 2 Drawing Sheets

(51) Int. Cl.

| | |
|---|---|
| ***D04H 1/724*** | (2012.01) |
| ***D04H 3/007*** | (2012.01) |
| ***D04H 3/016*** | (2012.01) |
| ***D04H 3/03*** | (2012.01) |

(58) Field of Classification Search
CPC .. D04H 13/00; D10B 2509/026; G06Q 20/12; G06Q 30/0631; G06Q 30/0633; G06Q 30/0641
See application file for complete search history.

(56) References Cited

U.S. PATENT DOCUMENTS

| | | | |
|---|---|---|---|
| 5,693,707 | A | 12/1997 | Cheng et al. |
| 6,692,825 | B2 | 2/2004 | Qin et al. |
| 2007/0129517 | A1 | 6/2007 | Lang et al. |
| 2010/0059906 | A1 | 3/2010 | Dee et al. |
| 2015/0099624 | A1 | 4/2015 | Lee et al. |
| 2015/0252130 | A1 | 9/2015 | Loick et al. |
| 2015/0315321 | A1 | 11/2015 | Won et al. |
| 2017/0114192 | A1 | 4/2017 | Kim et al. |
| 2017/0189575 | A1 | 7/2017 | Lee et al. |
| 2017/0226248 | A1 | 8/2017 | Kim et al. |
| 2017/0306528 | A1 | 10/2017 | Seo et al. |
| 2018/0313000 | A1 | 11/2018 | Seo et al. |

FOREIGN PATENT DOCUMENTS

| | | | | |
|---|---|---|---|---|
| CN | 104684969 | A | | 6/2015 |
| CN | 106459265 | A | | 2/2017 |
| CN | 106471017 | A | | 3/2017 |
| CN | 106574006 | A | | 4/2017 |
| CN | 107075761 | A | | 8/2017 |
| EP | 0268498 | A2 | | 5/1988 |
| EP | 2837641 | A1 | | 2/2015 |
| EP | 2881419 | A1 | | 6/2015 |
| EP | 3156427 | A1 | | 4/2017 |
| EP | 3165541 | A1 | | 5/2017 |
| EP | 3190216 | A1 | | 7/2017 |
| EP | 3336226 | A1 | | 6/2018 |
| JP | H01260014 | A | | 10/1989 |
| JP | 2546695 | B2 | | 10/1996 |
| JP | H1005583 | A | | 1/1998 |
| JP | H1018125 | A | | 1/1998 |
| JP | 2003073919 | A | | 3/2003 |
| JP | 3548651 | | * | 7/2004 ... A61F 2013/53061 |
| JP | 3548651 | B2 | | 7/2004 |
| JP | 2005068310 | A | | 3/2005 |
| JP | 2009518469 | A | | 5/2009 |
| JP | 2011144480 | A | | 7/2011 |
| JP | 2015168824 | A | | 9/2015 |
| JP | 2017517600 | A | | 6/2017 |
| KR | 20110050557 | A | | 5/2011 |
| KR | 101471982 | B1 | | 12/2014 |
| KR | 20150132817 | A | | 11/2015 |
| KR | 20150142636 | A | | 12/2015 |
| KR | 101720309 | B1 | | 3/2017 |
| KR | 20170028836 | A | | 3/2017 |
| WO | 199219799 | A1 | | 11/1992 |
| WO | 199324684 | A1 | | 12/1993 |
| WO | 199526209 | A1 | | 10/1995 |
| WO | 2010028326 | A1 | | 3/2010 |
| WO | 2015190879 | A1 | | 12/2015 |
| WO | 2017039392 | A1 | | 3/2017 |
| WO | 2017164496 | A1 | | 9/2017 |

OTHER PUBLICATIONS

Database WPI Week 198947, Thomson Scientific, London, GB, AN1989-345910, XP002799532.
Database WPI Week 199813, Thomson Scientific, London, GB, AN1998-141481, XP002799530.
Database WPI Week 201152, Thomson Scientific, London, GB, AN 2011-J75506, XP002799529.
Extended European Search Report including Written Opinion for Application No. EP18873652.4 dated Jul. 7, 2020, 17 pgs.
Search Report from Chinese Application No. 201880063066.1 dated Sep. 2, 2021. 2 pgs.
Allan, "Other Superabsorbent Polymer Forms and Types," Modern Superabsorbent Polymer Technology, 1998, pp. 223-231.
International Search Report for Application No. PCT/KR2018/012843 dated Feb. 7, 2019, 2 pages.
Odian, Principles of Polymerization, Second Edition, Copyright 1981 by John Wiley & Sons, Inc, p. 203.
Third Party Observation for PCT/KR2018/012843 submitted Feb. 20, 2020, 12 pages.
Schwalm, UV Coatings; Basics, Recent Developments and New Applications, Dec. 21, 2006, p. 115, Elsevier Science.

* cited by examiner

SUPER ABSORBENT POLYMER NON-WOVEN FABRIC AND PREPARATION METHOD OF THE SAME

CROSS-REFERENCE TO RELATED APPLICATIONS

The present application is a national phase entry under 35 U.S.C. § 371 of International Application No. PCT/KR2018/012843, filed on Oct. 26, 2018, which claims priority from Korean Patent Application No. 10-2017-0142612 filed on Oct. 30, 2017, the disclosures of which are incorporated herein by reference in their entirety.

BACKGROUND OF THE INVENTION

(a) Field of the Invention

The present disclosure relates to a super absorbent polymer non-woven fabric and a preparation method of the same.

(b) Description of the Related Art

A super absorbent polymer (SAP) is a type of synthetic polymeric material capable of absorbing 500 to 1000 times its own weight of moisture. The super absorbent polymers started to be practically applied in sanitary products, and they are now being widely used not only for hygiene products such as disposable diapers for children, etc., but also for water retaining soil products for gardening, water stop materials for the civil engineering and construction, sheets for raising seedling, fresh-keeping agents for food distribution fields, materials for poultices, or the like. Therefore, the super absorbent polymer (SAP), which is known to have excellent absorption capacity when compared with the conventional absorbers, has a wider range of application, and thus has a high market value.

Current super absorbent polymers are mostly manufactured and used in the form of powder. This powdery super absorbent polymer has a limited range of use, because it has to be scattered or leaked when manufacturing sanitary materials or in actual use and must be used with a specific type of substrate.

Recently, a preparation method of a super absorbent polymer in the form of fiber has been proposed. For example, Korean Patent Publication No. 2017-0028836 discloses a method of manufacturing a superabsorbent polymer fiber, including the steps of: preparing a neutralization solution by dissolving a water-soluble ethylenic unsaturated monomer in a sodium hydroxide aqueous solution; preparing a spinning solution by adding the neutralization solution with a cross-linking agent and then performing stirring; and producing a superabsorbent polymer fiber by subjecting the spinning solution to centrifugal spinning using a spinneret and then performing drying. However, the above method has disadvantages such as a decrease in productivity and permeability, because the fiber cannot be manufactured to have a diameter of 10 μm or more due to the characteristics of the centrifugal spinning.

U.S. Pat. No. 6,692,825 discloses a method of preparing a nonwoven web made of super absorbent polymer fibers having a diameter of 0.1 to 10 μm, which is a super absorbent polymer containing amide cross-linking. However, the amine-based monomer used in amide cross-linking may cause problems such as malodor, skin side effects and the like. Also, the prepared fiber has a diameter of 10 μm or less, which is the same disadvantage as the centrifugal spinning.

Japanese Patent No. 3548651 discloses a method of preparing a flexible super absorbent fiber laminate by adding a softening component to a monomer composition, and irradiating ultraviolet rays and polymerizing while dropping the monomer composition from a nozzle. However, the polymerization proceeds by ultraviolet rays during the falling time, so that the polymerization time is very short. Therefore, this method has a disadvantage in that residual monomers are increased due to the very short polymerization time, lowering the permeability and absorption rate of the super absorbent polymer.

PRIOR ART DOCUMENTS

Patent Documents (Patent Document 1) Korean Patent Publication No. 2017-0028836
(Patent Document 2) U.S. Pat. No. 6,692,825
(Patent Document 3) Japanese Patent No. 3548651

SUMMARY OF THE INVENTION

In order to solve the problems of the prior art as described above, the present disclosure is to provide a super absorbent polymer non-woven fabric exhibiting high flexibility and fast absorption rate in the form of long fibers, and a preparation method of the same.

One aspect of the present disclosure provides a super absorbent polymer non-woven fabric including super absorbent polymer fibers having a diameter of more than 10 μm and a length of 0.1 m or more, wherein a critical curvature is 0.5 $mm^{-1}$ or more.

Another aspect of the present disclosure provides a preparation method of a super absorbent polymer non-woven fabric, including the steps of:

preparing a first aqueous polymer solution containing a hydrogel polymer by polymerizing an aqueous monomer solution containing an acrylic acid-based monomer having at least partially neutralized acidic groups, a comonomer having a glass transition temperature (Tg) of room temperature (25° C.) or lower, and a polymerization initiator, mixing the first aqueous polymer solution with a cross-linking agent having a glass transition temperature (Tg) of room temperature (25° C.) or lower to prepare a second aqueous polymer solution;

spinning the second aqueous polymer solution by a solution blown process; and drying the spun second aqueous polymer solution to prepare a super absorbent polymer non-woven fabric comprising super absorbent polymer fibers.

The super absorbent polymer non-woven fabric according to the present disclosure can be directly applied to products in the form of a non-woven fabric unlike the conventional super absorbent polymer which is in the form of powder, and can exhibit flexibility without scattering or leaking.

Further, since each of the fibers constituting the non-woven fabric is composed of long fibers, it can exhibit high flexibility.

As described above, since the super absorbent polymer non-woven fabric has high flexibility and fast absorption rate due to inherent physical properties of the super absorbent polymer, it can be applied to various products requiring flexibility and high absorbency. For example, the super absorbent polymer non-woven fabric according to the present disclosure can be applied not only to all products using conventional super absorbent polymer powders but also to various fields such as permeable bags encapsulating the core of super absorbent polymer particles of sanitary materials such as diapers and sanitary napkins, waterproofing materials applied to walls, roofs, cables, etc., oil filters for removing moisture, dressings for wound and ulcer care, food packaging materials for preventing moisture-leaking, and sweat absorbing materials for fire-resistant clothing.

Also, according to the preparation method of the present disclosure, the above-mentioned super absorbent polymer non-woven fabric can be prepared with high productivity.

DETAILED DESCRIPTION OF THE EMBODIMENTS

Figure 1:
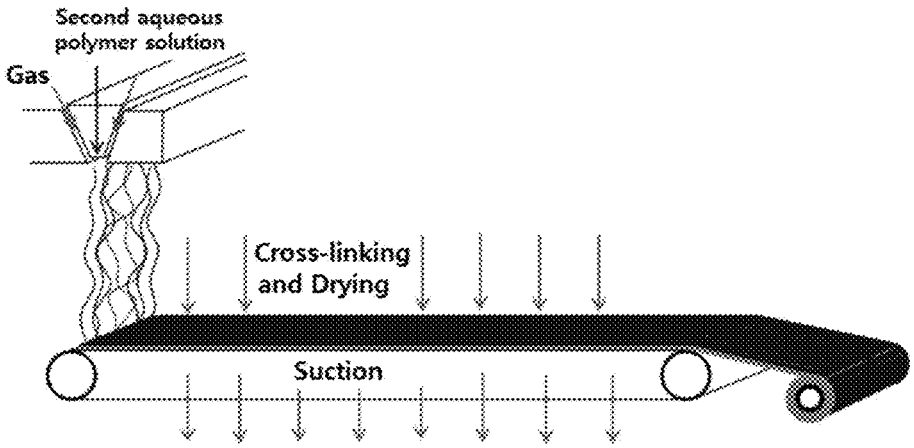
FIG. 1 is a schematic view showing a manufacturing process of a super absorbent polymer non-woven fabric according to one embodiment of the present disclosure.

As the present invention can be variously modified and have various forms, specific embodiments thereof are shown by way of examples and will be described in detail. However, it is not intended to limit the present invention to the particular form disclosed and it should be understood that the present invention includes all modifications, equivalents, and replacements within the idea and technical scope of the present invention.

Hereinafter, the super absorbent polymer non-woven fabric and the preparation method of the same according to the embodiments of the present disclosure will be described in more detail.

A super absorbent polymer non-woven fabric according to one embodiment of the present disclosure includes super absorbent polymer fibers having a diameter of more than 10 μm and a length of 0.1 m or more, and a critical curvature is 0.5 $mm^{-1}$ or more.

The super absorbent polymer non-woven fabric of the present disclosure includes super absorbent polymer fibers, and the super absorbent polymer fibers may be in the form of flexible long fibers.

Preferably, the super absorbent polymer non-woven fabric of the present disclosure may include the super absorbent polymer fibers as a main component. However, this does not mean that the super absorbent polymer non-woven fabric of the present disclosure cannot be used after mixing with super absorbent polymer powder, particles, or another type of superabsorbent resin, and the super absorbent polymer non-woven fabric can be mixed with any of the listed materials, other components, additives, and the like.

Incidentally, including the super absorbent polymer fibers as a main component means that the super absorbent polymer fibers having a diameter of more than 10 μm and a length of 0.1 m or more occupy about 50 parts by weight or more, about 60 parts by weight or more, or about 70 parts by weight or more and about 100 parts by weight or less, about 99.9 parts by weight or less, or about 99 parts by weight or less with respect to 100 parts by weight of the total super absorbent polymer non-woven fabric. The residual quantity may be occupied by water, super absorbent polymer fibers in the form of short fibers, a length of less than 0.1 m, particles and other additives.

The super absorbent polymer fibers may have a length of about 0.1 m or more, about 1 m or more, or about 2 m or more, and about 1000 m or less, about 100 m or less, or about 10 m or less. As the super absorbent polymer non-woven fabric of the present disclosure is composed of long fibers having a length of at least 0.1 m as described above, it can exhibit flexibility that does not break easily.

Moreover, the super absorbent polymer fibers may have a diameter of more than about 10 μm, more than about 15 μm, or more than about 20 μm, and about 200 μm or less, about 150 μm or less, or about 80 μm or less. As the super absorbent polymer non-woven fabric of the present disclosure is composed of fibers having a diameter of more than 10 μm as described above, the content of the super absorbent polymer per unit area can be increased and absorbency and permeability, which are inherent properties of the super absorbent polymer, can be maintained at a high level.

Further, the non-woven fabric including the super absorbent polymer fibers may have a critical curvature of about 0.5 $mm^{-1}$ or more, about 1 $mm^{-1}$ or more, or about 2 $mm^{-1}$ or more. The critical curvature means a reciprocal (1/r) of the minimum radius of curvature (r, unit: mm) that does not break when the fiber is bent. Accordingly, the super absorbent polymer non-woven fabric of the present disclosure can have flexibility such that it is not broken easily even when the radius of curvature is bent or folded to 2 mm or less.

As described above, since the super absorbent polymer fibers constituting the super absorbent polymer non-woven fabric of the present disclosure are flexible long fibers, the super absorbent polymer non-woven fabric including or consisting of the super absorbent polymer fibers also has high flexibility, so that it can be flexible and elastic without being broken even if bent.

Further, the super absorbent polymer fibers can exhibit excellent absorption ability and absorption rate.

For example, the super absorbent polymer fibers may have centrifuge retention capacity (CRC) of about 5 g/g or more, or about 10 g/g or more, and about 50 g/g or less, about 40 g/g or less, or about 30 g/g or less, as measured in accordance with EDANA method WSP 241.2.

Further, the super absorbent polymer fibers may have absorbency under load (AUL) at 0.9 psi of about 4 g/g or more, about 7 g/g or more, or about 10 g/g or more, and about 45 g/g or less, about 35 g/g or less, or about 30 g/g or less, as measured in accordance with EDANA WSP 242.2.

Further, the super absorbent polymer fibers may have saline flow conductivity (SFC) of about $5*10^{-7}$ $cm^3$·sec/g or more, about $10*10^{-7}$ $cm^3$·sec/g or more, or about $30*10^{-7}$ $cm^3$·sec/g or more, and about $120*10^{-7}$ $cm^3$·sec/g or less, about $110*10^{-7}$ $cm^3$·sec/g or less, or about $100*10^{-7}$ $cm^3$·sec/g or less.

According to one embodiment of the present disclosure, the specific surface area of the super absorbent polymer non-woven fabric may be about 0.5 $m^2$/g or more, about 1 $m^2$/g or more, or about 2 $m^2$/g or more, and about 100 $m^2$/g or less, about 70 $m^2$/g or less, or about 50 $m^2$/g or less.

The super absorbent polymer non-woven fabric according to the present disclosure can be suitably used in various applications such as hygiene materials, and hygroscopic materials by itself or by mixing with other resins, particles, powders, or other components having high absorbency.

The use of the super absorbent polymer non-woven fabric according to the present disclosure is not particularly limited and may cover all products used in various fields such as medicine, chemistry, chemical industry, foodstuffs or cosmetics. Specific examples thereof include hygiene products, permeable bags, waterproofing materials, filters for removing moisture, dressings, food packaging materials for preventing moisture-leaking, sweat absorbing materials and the like.

The above-mentioned super absorbent polymer non-woven fabric of the present disclosure can be prepared by the following method.

The preparation method of a super absorbent polymer non-woven fabric according to another embodiment of the present disclosure includes the steps of:

preparing a first aqueous polymer solution containing a hydrogel polymer by polymerizing an aqueous monomer solution containing an acrylic acid-based monomer having at least partially neutralized acidic groups, a comonomer having a glass transition temperature (Tg) of room temperature (25° C.) or lower, and a polymerization initiator, mixing the first aqueous polymer solution with a cross-linking agent having a glass transition temperature (Tg) of room temperature (25° C.) or lower to prepare a second aqueous polymer solution;

spinning the second aqueous polymer solution by a solution blown process; and drying the spun second aqueous polymer solution to prepare a super absorbent polymer non-woven fabric comprising super absorbent polymer fibers.

The preparation method of a super absorbent polymer non-woven fabric of the present disclosure prepares a first aqueous polymer solution containing a hydrogel polymer by polymerizing an aqueous monomer solution containing an acrylic acid-based monomer having at least partially neutralized acidic groups, a comonomer having a glass transition temperature (Tg) of room temperature (25° C.)

The acrylic acid-based monomer of the aqueous monomer solution is a compound represented by the following Chemical Formula 1:

$$R^1—COOM^1 \quad \text{[Chemical Formula 1]}$$

in Chemical Formula 1, $R^1$ is a C2 to C5 alkyl group having an unsaturated bond, and $M^1$ is a hydrogen atom, a monovalent or divalent metal, an ammonium group, or an organic amine salt.

Preferably, the acrylic acid-based monomer includes at least one selected from the group consisting of acrylic acid, methacrylic acid, and a monovalent metal salt, a divalent metal salt, an ammonium salt, and an organic amine salt thereof.

Herein, the acrylic acid-based monomers may be those having acidic groups which are at least partially neutralized. Preferably, the acrylic acid-based monomer partially neutralized with an alkali substance such as sodium hydroxide, potassium hydroxide, ammonium hydroxide, or the like may be used. A degree of neutralization of the acrylic acid-based monomer may be about 40 to 95 mol %, about 40 to 80 wt %, or about 45 to 75 mol %. The range of the degree of neutralization can be adjusted according to final properties. An excessively high degree of neutralization causes the neutralized monomers to be precipitated, and thus polymerization may not readily occur, whereas an excessively low degree of neutralization not only deteriorates the absorbency of the polymer, but also endows the polymer with hard-to-handle properties, such as those of an elastic rubber.

Meanwhile, in the preparation method of a super absorbent polymer non-woven fabric according to the present disclosure, the concentration of the acrylic acid-based monomer may be appropriately selected in consideration of the reaction time and the reaction conditions. Preferably, the acrylic acid-based monomer is contained in an amount of 10 to 50 wt % based on a total weight of the aqueous monomer solution. When the concentration of the acrylic acid-based monomer is less than 10 wt %, it is not economical. When it exceeds 50 wt %, viscosity becomes high and the fiber form cannot be obtained.

In the preparation method of a super absorbent polymer non-woven fabric according to the present disclosure, the aqueous monomer solution contains a comonomer having a glass transition temperature (Tg) of room temperature (25° C.) or lower.

The comonomer is copolymerized with an acrylic acid-based monomer during polymerization to enable polymerization of a super absorbent polymer in the form of flexible long fibers.

When a hydrogel polymer is formed by including a comonomer having a glass transition temperature (Tg) exceeding room temperature, or only with an acrylic acid-based monomer, the resulting super absorbent polymer fibers may easily break due to their deteriorated flexibility.

The comonomer has a glass transition temperature (Tg) of room temperature (25° C.) or lower, and has a functional group capable of polymerizing with an acrylic acid-based monomer. For example, C1 to C10 vinyl alkyl ether, C1 to C10 alkyl acrylate, methoxyethyl acrylate, C1 to C10 hydroxyalkyl (meth)acrylate, polyethylene glycol (methyl ether) acrylate having 1 to 20 ethylene glycol, polyethylene glycol (methyl ether) methacrylate having 1 to 20 ethylene glycol, or 2-ethylhexyl (meth)acrylate may be used. Preferably, polyethylene glycol (methyl ether) acrylate may be used.

The comonomer may be contained in an amount of 0.1 to 30 parts by weight, preferably 0.5 to 25 parts by weight, more preferably 1 to 20 parts by weight based on 100 parts by weight of the acrylic acid-based monomer. When the amount of the comonomer is too small, the effect of improving the flexibility may be insignificant. When the amount of the comonomer is too large, the absorption rate and the absorption ability may be lowered. Accordingly, the above range is preferred.

As the polymerization initiator, a polymerization initiator generally used in the preparation of a super absorbent polymer may be used. A thermal polymerization initiator, a photopolymerization initiator, a redox polymerization initiator or the like may be used depending on the polymerization method. However, in view of polymerization efficiency, it may be more preferable to use two types of polymerization initiators in combination, rather than using a thermal polymerization initiator or a photopolymerization initiator alone. This is because a certain amount heat is generated by UV radiation and some heat occurs as the polymerization reaction, which is an exothermal reaction, progresses, even when the photopolymerization method is applied thereto. Therefore, when a thermal polymerization initiator is included in the photopolymerization, thermal polymerization may occur at the same time.

For example, the photopolymerization initiator may be one or more compounds selected from the group consisting of benzoin ether, dialkyl acetophenone, hydroxyl alkylketone, phenyl glyoxylate, benzyl dimethyl ketal, acyl phosphine, and α-aminoketone. Further, as the specific example of acyl phosphine, commercial Lucirin TPO, namely, 2,4,6-trimethyl-benzoyl-trimethyl phosphine oxide, may be used. More various photopolymerization initiators are well disclosed in "UV Coatings: Basics, Recent Developments and New Application (Elsevier, 2007)" written by Reinhold Schwalm, p 115, and this can be referred to.

Furthermore, as the thermal polymerization initiator, one or more initiators selected from the group consisting of a persulfate-based initiator, an azo-based initiator, hydrogen peroxide, and ascorbic acid may be used. Specifically, sodium persulfate ($Na_2S_2O_8$), potassium persulfate ($K_2S_2O_8$), ammonium persulfate ($(NH_4)_2S_2O_8$) and the like may be used as examples of the persulfate-based initiators; and 2,2-azobis-(2-amidinopropane)dihydrochloride, 2,2-azobis-(N,N-dimethylene)isobutyramidinedihydrochloride, 2-(carbamoylazo)isobutylonitril, 2,2-azobis-[2-(2-imidazolin-2-yl)propane]dihydrochloride, 4,4-azobis-(4-cyanovaleric acid), and the like may be used as examples of azo-based initiators. More various thermal polymerization initiators are well disclosed in "Principle of Polymerization (Wiley, 1981)" written by Odian, p 203, and this can be referred to.

In the redox polymerization, a polymerization initiator and a polymerization reducing agent are used at the same time. The redox polymerization initiator includes a compound having a peroxide-based component (i.e., a peroxide-based compound). For example, peroxide-based compounds such as hydrogen peroxide like t-butyl hydrogen peroxide and cumene peroxide; peroxides such as benzoyl peroxide, caprylyl peroxide, di-t-butyl peroxide, ethyl 3,3'-di-(t-butylperoxy) butyrate, ethyl 3,3'-di(t-amylperoxy) butyrate, t-amyl peroxy-2-ethylhexanoate, or t-butyl peroxypivalate; peresters such as t-butyl peracetate, t-butyl perphthalate, or t-butyl perbenzoate; percarbonates such as di(1-cyano-1-methylethyl) peroxy dicarbonate; or perphosphates may be used. Examples of the redox polymerization reducing agent include ascorbic compounds such as ascorbic acid or isoascorbic acid.

The polymerization initiator may be added at a concentration of about 0.001 to 1 wt % with respect to the aqueous monomer solution. That is, when the concentration of the polymerization initiator is too low, the polymerization rate may be slowed, and a large amount of residual monomer may be extracted in the final product. On the contrary, when the concentration of the polymerization initiator is too high, the polymer chain forming network is shortened, so that physical properties of the resin may be lowered, such that the content of water-soluble component is increased and absorption ability under pressure is lowered.

In the present method, the aqueous monomer solution may further include an additive such as a thickener, a plasticizer, a preservation stabilizer, an antioxidant, and the like, if necessary.

The raw materials such as the acrylic acid-based monomer, the comonomer having a glass transition temperature (Tg) of room temperature or lower, the polymerization initiator, and the additive may be prepared in the form of a aqueous solution dissolved in water. The water may be included in the aqueous monomer solution at a residual quantity except for the above components.

Subsequently, the aqueous monomer solution is thermally polymerized or photopolymerized to form a hydrogel polymer, whereby a first aqueous polymer solution.

Meanwhile, the method of preparing the hydrogel polymer by thermal polymerization or photopolymerization of the aqueous monomer solution is not particularly limited if it is a common polymerization method.

Specifically, the polymerization method is largely divided into the thermal polymerization and the photopolymerization according to the energy source of the polymerization. In the case of thermal polymerization, it is generally carried out in a reactor having a kneading spindle, such as a kneader. In the case of photopolymerization, it may be carried out in a reactor equipped with a movable conveyor belt. However, the polymerization method is just an example, and the present invention is not limited thereto.

Generally, the moisture content of the hydrogel polymer obtained by the above method may be about 40 to about 80 wt %. At this time, "moisture content" in the present description is the ratio of the weight of moisture to the entire weight of the hydrogel polymer, and it means the difference between the weight of the dried polymer and the weight of the hydrogel polymer. Specifically, the moisture content is defined as a value calculated from the weight loss due to moisture evaporation from the polymer in the process of increasing the temperature of the polymer and drying the same through infrared heating. At this time, the drying condition for measuring the moisture content is that the temperature is increased to about 180° C. and maintained at 180° C., and the total drying time is 20 min including 5 min of a heating step.

A second aqueous polymer solution is prepared by mixing the first aqueous polymer solution containing the hydrogel polymer with a cross-linking agent.

In the preparation method of a super absorbent polymer non-woven fabric, the cross-linking agent is a compound capable of reacting with a functional group contained in the polymer and has a glass transition temperature (Tg) of room temperature (25° C.) or lower. The cross-linking agent is subjected to a cross-linking reaction with the polymer in the subsequent drying step, whereby a super absorbent polymer in the form of flexible long fibers can be prepared.

As the cross-linking agent satisfying the above conditions, at least one selected from the group consisting of ethyleneglycol, glycerol, polyethyleneglycol, polypropylene glycol, poly(4-hydroxybutyl acrylate), poly(2-hydroxyethyl acrylate), and poly(2-hydroxypropyl acrylate) may be used, and ethylene glycol may be preferably used.

The cross-linking agent may be contained in an amount of 0.1 to 30 parts by weight, preferably 0.5 to 25 parts by weight, more preferably 1 to 20 parts by weight based on 100 parts by weight of the monomer contained in the aqueous monomer solution. When the amount of the cross-linking agent is too small, the cross-linking reaction hardly occurs. When the amount is too large, physical properties of the super absorbent polymer fibers may be deteriorated due to excessive cross-linking reaction.

Subsequently, the prepared second aqueous polymer solution is then spun out by a solution blown process.

Methods such as melt-blown spinning, jet spinning, centrifugal spinning, electro spinning and the like are known as methods for preparing polymers in the form of fibers or non-woven fabrics.

The centrifugal spinning is a method of producing a non-woven fabric by adding a molten or solution-state polymer into a spinneret having a plurality of holes, spinning it at a high speed, and stretching the non-solidified polymer using a centrifugal force applied thereto to laminate the thinned and solidified fibers on a collector. The advantage of the centrifugal spinning is that it has simple equipment, low energy consumption and fewer restrictions on the polymer to be used, and it can simplify the process because it produces the polymer in the form of non-woven fabrics.

However, the centrifugal spinning is difficult to mass-produce, resulting in poor productivity, and is not suitable for producing long fibers having a diameter exceeding 10 μm, and accordingly, there is a problem that absorption rate is low. Therefore, as a method to resolve this problem, the present disclosure forms super absorbent polymer fibers by a solution blown process.

In the preparation method of the present disclosure, the solution blown process refers to a process of spinning a second aqueous polymer solution containing a hydrogel polymer through microchannels in the form of thin streams, and simultaneously drying and cross-linking the spun second aqueous polymer solution to continuously prepare a non-woven fabric made of flexible super absorbent polymer fibers.

FIG. 1 is a schematic view showing a manufacturing process according to one embodiment of the present disclosure. Referring to FIG. 1, the prepared second aqueous polymer solution is spun onto a movable conveyor belt or the like, and may be continuously spun through microchannels or nozzles having a width of 1000 μm or less. A gas such as air or an inert gas may also be flowed around the stream of the spun aqueous polymer solution to form a more uniform stream.

Subsequently, super absorbent polymer fibers are prepared by drying the spun second aqueous polymer solution. According to one embodiment of the present disclosure, the moisture generated during the polymerization of the second aqueous polymer solution may be removed by continuous suction for more effective drying during the drying process.

Meanwhile, due to the temperature elevated in the drying step, the hydrogel polymer contained in the second aqueous polymer solution and the cross-linking agent are subjected to a cross-linking reaction to form more flexible super absorbent polymer fibers.

The drying step may be carried out at a temperature of 100 to 250° C. When the drying temperature is lower than 100° C., the drying time may become excessively long and the properties of the super absorbent polymer fiber finally prepared may decline. And when the drying temperature is higher than 250° C., the surface of the fiber is excessively dried, and the properties of the super absorbent polymer fiber finally prepared may decline. Therefore, the drying process may be preferably carried out at a temperature of 100 to 250° C., more preferably at a temperature of 150 to 200° C.

Furthermore, the drying time may be about 10 to 120 minutes, more preferably 20 to about 90 minutes in consideration of process efficiency, but it is not limited thereto.

The drying method in the drying step is not particularly limited if it has been generally used in the drying process of the hydrogel polymer. Specifically, the drying step may be carried out by the method of hot air provision, infrared radiation, microwave radiation, UV ray radiation, and the like.

Meanwhile, in the preparation method of a conventional super absorbent polymer in the form of powder, a hydrogel polymer having a moisture content of about 40 to about 80 wt % is obtained by polymerizing an aqueous monomer solution. And then, the hydrogel polymer is dried and pulverized to obtain a super absorbent polymer in the form of powder.

However, according to one embodiment of the present disclosure, the cross-linking and drying processes are simultaneously carried out for the spun aqueous polymer solution, whereby a super absorbent polymer non-woven fabric which is a network of super absorbent polymer fibers can be obtained.

A better understanding of the present invention may be obtained via the following examples, which are set forth to illustrate, but are not to be construed as limiting the scope of the present invention. The scope of the present invention is given by the claims, and also contains all modifications within the meaning and range equivalent to the claims.

EXAMPLES

Example 1

30 parts by weight of acryl acid, 0.9 parts by weight of polyethylene glycol (methyl ether) acrylate, 0.45 parts by weight of 3-mercaptopropionic acid, 10.8 parts by weight of sodium hydroxide (NaOH), and 57.75 parts by weight of water were mixed and stirred at 65° C. for 1 hour, while nitrogen gas ($N_2$) was purged. Then, 0.1 parts by weight of sodium persulfate (SPS) was added and a polymerization reaction was carried out for 10 hours to prepare a first aqueous polymer solution containing a hydrogel polymer. Thereafter, 0.5 parts by weight of ethylene glycol was mixed therewith to prepare a second aqueous polymer solution.

The prepared aqueous polymer solution was spun by a solution blown process as shown in FIG. 1, cross-linked at 180° C. for 100 minutes, and dried to obtain a non-woven fabric which is a network of super absorbent polymer fibers.

Figure 2:
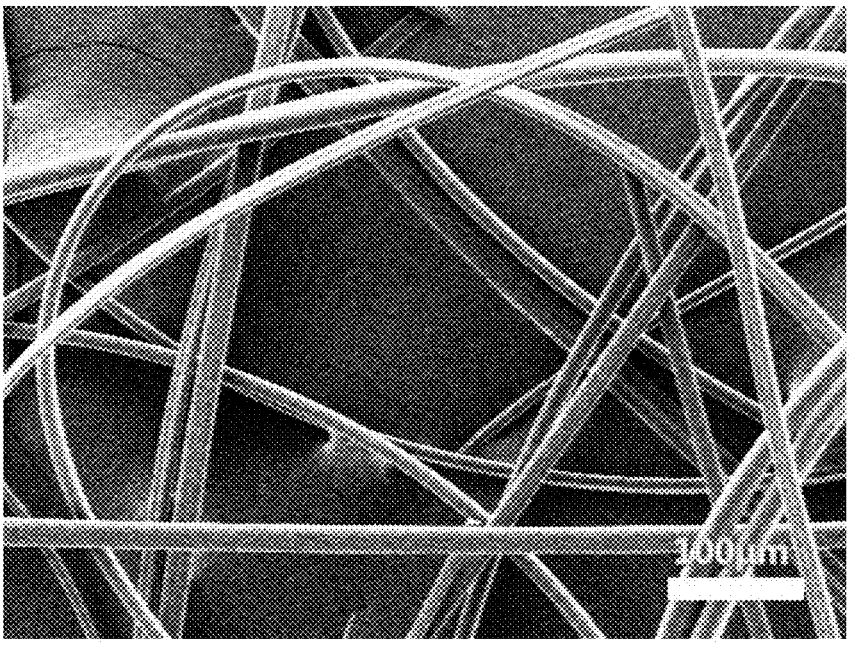
FIG. 2 is a scanning electron microscope (SEM) image of super absorbent polymer fibers according to an Example of the present disclosure.

A scanning electron microscope (SEM) image of the non-woven fabric made of the above super absorbent polymer fibers is shown in FIG. 2.

As a result of magnified observation of the super absorbent polymer fibers, the diameter of the super absorbent polymer fibers was about 25 to about 37 μm, and the length was about 1 to about 2 m. The critical curvature (1/r) of the super absorbent polymer non-woven fabric was 0.7 $mm^{-1}$.

Example 2

A non-woven fabric made of super absorbent polymer fibers was prepared in the same manner as in Example 1, except that 0.3 parts by weight of polyethylene glycol (methyl ether) acrylate and 58.35 parts by weight of water were used, and 1.3 parts by weight of polyethylene glycol having an average molecular weight of 200 g/mol was used instead of ethylene glycol as a cross-linking agent.

According to a magnified observation of the super absorbent polymer fibers, the diameter of the super absorbent polymer fibers was about 22 to about 34 μm, and the length was about 1 to about 2 m. The critical curvature (1/r) of the super absorbent polymer non-woven fabric was 1.1 $mm^{-1}$.

Comparative Example 1

A non-woven fabric made of super absorbent polymer fibers was prepared in the same manner as in Example 1, except that polyethylene glycol (methyl ether) acrylate was not used and 58.65 parts by weight of water was used.

Comparative Example 2

The first and second aqueous polymer solutions having the same composition as in Example 1 were prepared, and centrifugal spinning was used to produce a non-woven fabric. It was cross-linked at 180° C. for 100 minutes and dried to obtain a non-woven fabric which is a network of super absorbent polymer fibers.

Figure 3:
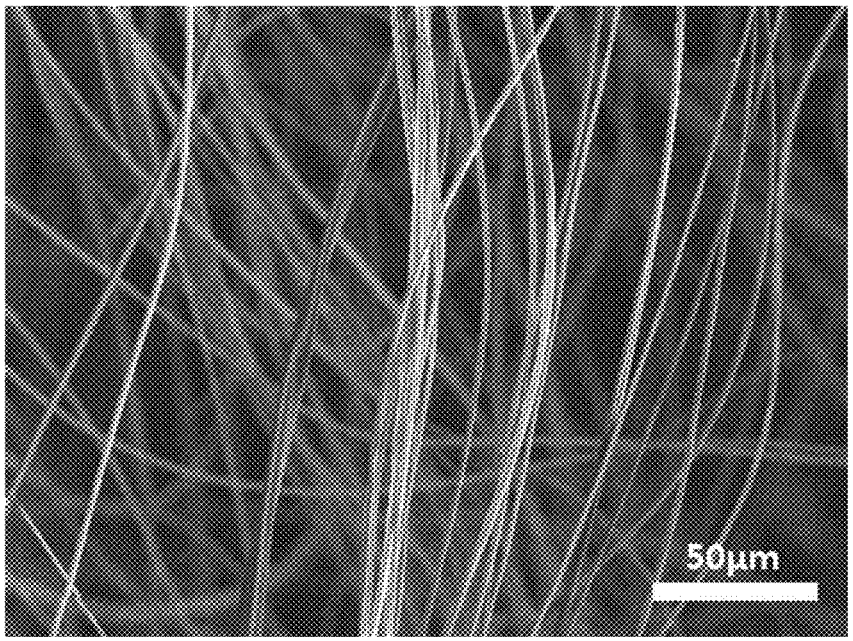
FIG. 3 is a scanning electron microscope (SEM) image of super absorbent polymer fibers according to a Comparative Example of the present disclosure.

A scanning electron microscope image of the non-woven fabric made of the above super absorbent polymer fibers is shown in FIG. 3.

According to a magnified observation of the super absorbent polymer fibers, the diameter of the super absorbent polymer fibers was about 4 to about 6 μm, and the length was about 1 to about 2 m. The critical curvature (1/r) of the super absorbent polymer non-woven fabric was 2 $mm^{-1}$.

Comparative Example 3

A non-woven fabric made of super absorbent polymer fibers was prepared in the same manner as in Example 1, except that 0.9 parts by weight of vinyl acetate having a glass transition temperature (Tg) of 34° C. was used instead of polyethylene glycol (methyl ether) acrylate.

According to a magnified observation of the super absorbent polymer fibers, the diameter of the super absorbent polymer fibers was about 24 to about 33 μm, and the length was about 1 to about 2 m. The critical curvature (1/r) of the super absorbent polymer non-woven fabric was 0.1 $mm^{-1}$.

Comparative Example 4

A non-woven fabric made of super absorbent polymer fibers was prepared in the same manner as in Example 1, except that ethylene glycol cross-linking agent was not used. However, the prepared non-woven fabric was not able to evaluate absorption properties such as centrifuge retention capacity, since it had a low degree of cross-linking, so that it was dissolved in water.

Comparative Example 5

Super absorbent polymer fibers were prepared in the same manner as in Example 1 of Japanese Patent No. 3548651.

Specifically, 0.05 parts by weight of polyethylene glycol (PEG200) diacrylate, 0.2 parts by weight of polyethylene oxide, and 2 parts by weight of 2-hydroxy-2-methyl-1-phenylpropan-1-one were dissolved in 100 parts by weight of an aqueous solution of partially neutralized (173%) acrylic acid neutralized with sodium hydroxide (monomer concentration: 45 wt %). This aqueous monomer solution was irradiated with ultraviolet rays for 2 seconds from a high-pressure mercury lamp (80 $W/cm^2$) on the side and polymerized, while falling from a nozzle having an inner diameter of 0.97 mm.

According to a magnified observation of the super absorbent polymer fibers, the diameter of the super absorbent polymer fibers was about 24 to about 33 μm, and the length was about 1 to about 2 m. The critical curvature (1/r) of the super absorbent polymer non-woven fabric was 0.1 $mm^{-1}$.

Experimental Examples (1) Centrifuge Retention Capacity (CRC)

The CRC of the super absorbent polymer fibers prepared in Examples and Comparative Examples was measured in accordance with EANA WSP 241.2, except that the super absorbent polymer in the form of fibers was used instead of the super absorbent polymer in the form of particles.

Specifically, $W_0$ (g) (about 0.2 g) of the super absorbent polymer fibers were uniformly placed into a non-woven bag, and sealed. Then, it was immersed in physiological saline (0.9 wt %) at room temperature. After 30 minutes, water was drained from the bag by centrifugal device under the condition of 250 G for 3 minutes, and the weight $W_2$ (g) of the bag was measured. In addition, the same manipulation was performed for an empty bag without the super absorbent polymer, and the weight $W_1$ (g) of the bag was measured.

The CRC (g/g) was calculated by using the obtained weight values according to the following Equation 1.

$$\text{CRC (g/g)}=\{[W_2\text{ (g)}-W_1\text{ (g)}]/W_0\text{ (g)}\}-1 \quad \text{[Equation 1]}$$

In Equation 1, $W_0$ (g) is an initial weight (g) of the super absorbent polymer fibers, $W_1$ (g) is a weight of the apparatus measured after dehydrating the same by using a centrifuge at 250 G for 3 min without using the super absorbent polymer fibers, and $W_2$ (g) is a weight of the device with the super absorbent polymer fibers measured after immersing the super absorbent polymer fibers in a 0.9 wt % saline solution for 30 min at room temperature and dehydrating the same by using a centrifuge at 250 G for 3 min.

(3) Absorbency Under Load (AUL)

The AUL at 0.9 psi of the super absorbent polymer fibers prepared in Examples and Comparative Examples was measured in accordance with EDANA WSP 242.2, except that the super absorbent polymer in the form of fibers was used instead of the super absorbent polymer in the form of particles.

Specifically, a 400 mesh stainless steel screen was installed in a cylindrical bottom of a plastic having an internal diameter of 25 mm. $W_0$ (g, about 0.16 g) of the absorbent polymer fibers to be measured were uniformly scattered on the screen at room temperature and a humidity of 50%. Thereafter, a piston which can uniformly provide a load of 0.9 psi was put on the super absorbent polymer. Herein, the external diameter of the piston was slightly smaller than 25 mm, there was no gap between the cylindrical internal wall and the piston, and the jig-jog of the cylinder was not interrupted. At this time, the weight $W_3$ (g) of the device was measured.

Subsequently, a glass filter having a diameter of 90 mm and a thickness of 5 mm was put in a Petri dish having a diameter of 150 mm, and 0.90 wt % physiological saline was poured in the dish. At this time, the physiological saline was poured until the surface level of the saline became equal to the upper surface of the glass filter. One filter paper having a diameter of 90 mm was put thereon.

Thereafter, the prepared device was placed on the filter paper so that the super absorbent polymer in the device was swelled by physiological saline under a load. After one hour, the weight $W_4$ (g) of the device containing the swollen super absorbent polymer was measured.

The AUL was calculated by using the obtained weight values according to the following Equation 2.

$$\text{AUL (g/g)}=[W_4\text{ (g)}-W_3\text{ (g)}]/W_0\text{ (g)} \quad \text{[Equation 2]}$$

In Equation 2, $W_0$ (g) is an initial weight (g) of the super absorbent polymer fibers, $W_3$ (g) is a sum of a weight of the super absorbent polymer fibers and a weight of the device providing a load to the polymer, and $W_4$ (g) is a sum of a weight of the super absorbent polymer fibers and a weight of the device providing a load to the polymer measured after making the super absorbent polymer fibers absorb the saline for one hour under a load (0.9 psi).

(3) Saline Flow Conductivity (SFC)

The SFC was measured and calculated in accordance with the method disclosed in columns 54 to 59 of U.S. Pat. No. 5,562,646.

(4) 0.3 Psi AUL @5 s, @15 s, @30 s, @60 s

The AUL at 0.3 psi of the super absorbent polymer fibers prepared in Examples and Comparative Examples was measured in accordance with EDANA WSP 242.2, except that the super absorbent polymer in the form of fibers was used instead of the super absorbent polymer in the form of particles and the swelling time was changed to 5 seconds, 15 seconds, 30 seconds and 60 seconds, respectively, instead of 1 hour.

Specifically, a 400 mesh stainless steel screen was installed in a cylindrical bottom of a plastic having an internal diameter of 25 mm. $W_0$ (g, about 0.16 g) of the absorbent polymer fibers to be measured were uniformly scattered on the screen at room temperature and a humidity of 50%. Thereafter, a piston which can uniformly provide a load of 0.3 psi was put on the super absorbent polymer. Herein, the external diameter of the piston was slightly smaller than 25 mm, there was no gap between the cylindrical internal wall and the piston, and the jig-jog of the cylinder was not interrupted. At this time, the weight $W_3$ (g) of the device was measured.

Subsequently, a glass filter having a diameter of 90 mm and a thickness of 5 mm was put in a Petri dish having a diameter of 150 mm, and 0.90 wt % physiological saline was poured in the dish. At this time, the physiological saline was poured until the surface level of the saline became equal to the upper surface of the glass filter. One filter paper having a diameter of 90 mm was put thereon.

Thereafter, the prepared device was placed on the filter paper so that the super absorbent polymer in the device was swelled by physiological saline under a load. After 5 seconds, the weight $W_4$ (g) of the device containing the swollen super absorbent polymer was measured.

The AUL (0.3 psi AUL @5 s) was calculated by using the obtained weight values according to the following Equation 2.

$$\text{AUL (g/g)}=[W_4\text{ (g)}-W_3\text{ (g)}]/W_0\text{ (g)} \quad \text{[Equation 2]}$$

In Equation 2, $W_0$ (g) is an initial weight (g) of the super absorbent polymer fibers, $W_3$ (g) is a sum of a weight of the super absorbent polymer fibers and a weight of the device providing a load to the polymer, and $W_4$ (g) is a sum of a weight of the super absorbent polymer fibers and a weight of the device providing a load to the polymer measured after making the super absorbent polymer fibers absorb the saline for 5 seconds under a load (0.3 psi).

The AUL was measured in the same manner as above, except that the absorbing (swelling) time of the saline was changed to 15 seconds (0.3 psi AUL @15 s), 30 seconds (0.3 psi AUL @30 s), and 60 seconds (0.3 psi AUL @60 s), respectively.

(5) Flexibility

Figure 4:
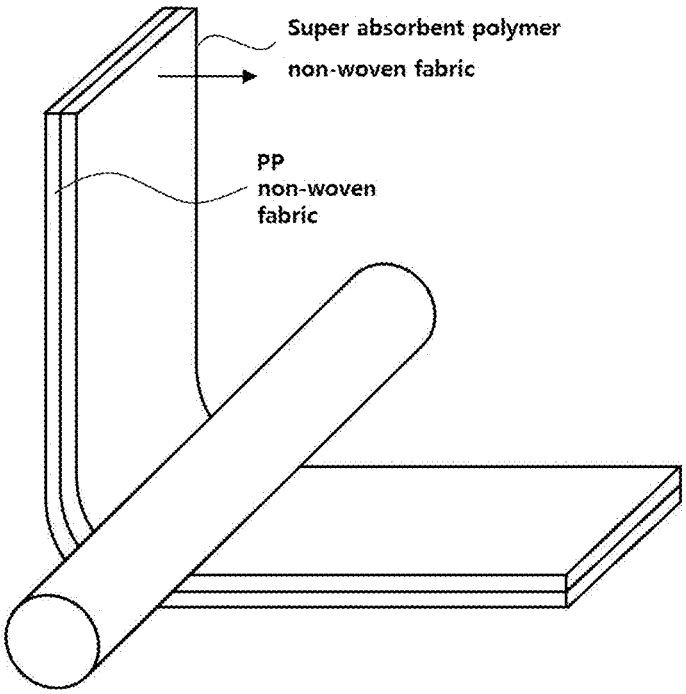
FIG. 4 is a schematic view showing a method for evaluating flexibility of a super absorbent polymer non-woven fabric.

A schematic view showing a method for evaluating flexibility of the super absorbent polymer non-woven fabrics prepared in Examples and Comparative Examples is shown in FIG. 4.

A non-woven fabric made of super absorbent polymer fibers having a width of 20 mm, a length of 60 mm and a weight per unit area of 35 g/m$^2$ was prepared, and a PP non-woven fabric was adhered to the outside of the non-woven fabric in the same size so as to cover the super absorbent polymer non-woven fabric. A SUS rod having a diameter of 1 mm was placed in the middle of the non-woven fabric, and the non-woven fabric was bent in a circular shape along the rim of the SUS rod to observe a breakage of the non-woven fabric with the naked eye and an optical microscope. It was evaluated as '○' when fibers of the non-woven fabric were not broken, and 'X' when they were broken.

The properties of the super absorbent polymer fibers prepared in Examples and Comparative Examples were evaluated in the same manner as described above, and are shown in Table 1 below. Comparative Example 4 was not able to evaluate absorption properties such as centrifuge retention capacity, since it had a low degree of cross-linking, so that it was dissolved in water.

TABLE 1

| | Ex. 1 | Ex. 2 | Comp. Ex. 1 | Comp. Ex. 2 | Comp. Ex. 3 | Comp. Ex. 5 |
|---|---|---|---|---|---|---|
| CRC (g/g) | 14.0 | 11.3 | 13.0 | 13.5 | 10.5 | 18.4 |
| 0.9 psi AUL (g/g) | 12.8 | 12.0 | 11.3 | 12.1 | 9.7 | 19.1 |
| SFC (*$10^{-7}$ cm$^3$ · sec/g) | 35 | 97 | 62 | 3.9 | 36 | 1 |
| 0.3 psi AUL @5 s | 7.1 | 7.8 | 10.3 | 8.4 | 3.5 | 3.3 |
| 0.3 psi AUL @15 s | 11.8 | 12.4 | 12.8 | 11.8 | 5.3 | 4.7 |
| 0.3 psi AUL @30 s | 13.0 | 12.6 | 13.5 | 12.9 | 7.9 | 8.5 |
| 0.3 psi AUL @60 s | 14.1 | 13.1 | 13.7 | 12.1 | 10.1 | 12.3 |
| Flexibility | ○ | ○ | X | ○ | X | ○ |

Referring to Table 1, the super absorbent polymer non-woven fabrics prepared according to Examples of the present disclosure were composed of long fibers, and exhibited high flexibility with a critical curvature of 0.5 mm$^{-1}$ or more and competent water retention capacity and absorption rate.

However, Comparative Examples 1 and 3 were less flexible than the non-woven fabric of the present disclosure, and Comparative Example 2 produced by the centrifugal spinning showed low absorption rate and was not suitable for products. Comparative Example 5 had very low flowability and absorption rate of the saline solution, which was also unsuitable for products.

What is claimed is:

1. A super absorbent polymer non-woven fabric comprising super absorbent polymer fibers having a diameter of more than 10 μm and a length of 0.1 m or more, wherein a critical curvature is 0.5 mm$^{-1}$ or more.

2. The super absorbent polymer non-woven fabric of claim 1, wherein the super absorbent polymer fibers have centrifuge retention capacity (CRC) of 5 to 50 g/g as measured in accordance with EDANA method WSP 241.2.

3. The super absorbent polymer non-woven fabric of claim 1, wherein the super absorbent polymer fibers have absorbency under load (AUL) at 0.9 psi of 4 to 45 g/g, as measured in accordance with EDANA WSP 242.2.

4. The super absorbent polymer non-woven fabric of claim 1, wherein the super absorbent polymer fibers have saline flow conductivity (SFC) of 5*$10^{-7}$ to 120*$10^{-7}$ cm$^3$·sec/g.

5. The super absorbent polymer non-woven fabric of claim 1, wherein the super absorbent polymer fibers are present in an amount of 50 parts by weight or more based on 100 parts by weight of the super absorbent polymer non-woven fabric.

6. A preparation method of the super absorbent polymer non-woven fabric of claim 1, comprising:

preparing a first aqueous polymer solution containing a hydrogel polymer by polymerizing an aqueous monomer solution containing an acrylic acid-based monomer having at least partially neutralized acidic groups, a comonomer having a glass transition temperature (Tg) of room temperature (25° C.) or lower, and a polymerization initiator, mixing the first aqueous polymer solution with a cross-linking agent having a glass transition temperature (Tg) of room temperature (25° C.) or lower to prepare a second aqueous polymer solution;

spinning the second aqueous polymer solution by a solution blown process; and drying the spun second aqueous polymer solution to prepare the super absorbent polymer non-woven fabric comprising the super absorbent polymer fibers.

7. The preparation method of claim 6, wherein the comonomer having a glass transition temperature (Tg) of room temperature (25° C.) or lower comprises at least one of C1 to C10 vinyl alkyl ether, C1 to C10 alkyl acrylate, methoxyethyl acrylate, C1 to C10 hydroxyalkyl (meth)acrylate, polyethylene glycol (methyl ether) acrylate having 1 to 20 ethylene glycol, polyethylene glycol (methyl ether) methacrylate having 1 to 20 ethylene glycol, or 2-ethylhexyl (meth)acrylate.

8. The preparation method of claim 6, wherein the comonomer having a glass transition temperature (Tg) of room temperature (25° C.) or lower is added in an amount of 0.1 to 30 parts by weight based on 100 parts by weight of the acrylic acid-based monomer.

9. The preparation method of claim 6, wherein the cross-linking agent having a glass transition temperature (Tg) of room temperature (25° C.) or lower comprises at least one of ethyleneglycol, glycerol, polyethyleneglycol, polypropylene glycol, poly(4-hydroxybutyl acrylate), poly(2-hydroxyethyl acrylate), or poly(2-hydroxypropyl acrylate).

10. The preparation method of claim 6, wherein the cross-linking agent having a glass transition temperature (Tg) of room temperature (25° C.) or lower is added in an amount of 0.1 to 30 parts by weight contained in the aqueous monomer solution.

11. The preparation method of claim 6, wherein the super absorbent polymer fibers have a length of 0.1m or more and a diameter of more than 10 μm.

12. The preparation method of claim 6, wherein a cross-linking reaction between the hydrogel polymer and the cross-linking agent is performed during the drying of the spun second aqueous polymer solution.

13. The preparation method of claim 6, wherein the spinning of the second aqueous polymer solution by a solution blown process is carried out by continuously spinning the second aqueous polymer solution onto a conveyor belt through microchannels while flowing gas.

* * * * *